US008038524B2

(12) United States Patent
Bryant et al.

(10) Patent No.: US 8,038,524 B2
(45) Date of Patent: Oct. 18, 2011

(54) GAMING MACHINE WITH BUY FEATURE GAMES

(75) Inventors: Natalie Bryant, Lane Cove (AU); Nicholas Luke Bennett, Lane Cove (AU)

(73) Assignee: Aristocrat Technologies Australia Pty Ltd (AU)

( * ) Notice: Subject to any disclaimer, the term of this patent is extended or adjusted under 35 U.S.C. 154(b) by 822 days.

(21) Appl. No.: 12/018,605

(22) Filed: Jan. 23, 2008

(65) Prior Publication Data

US 2008/0214292 A1 Sep. 4, 2008

Related U.S. Application Data

(63) Continuation of application No. 10/070,266, filed on Jul. 19, 2002, now abandoned.

(51) Int. Cl.
*A63F 9/24* (2006.01)

(52) U.S. Cl. ..... 463/20; 463/29; 463/25

(58) Field of Classification Search ..... 463/20, 463/25, 29

See application file for complete search history.

(56) References Cited

U.S. PATENT DOCUMENTS

| | | | |
|---|---|---|---|
| 1,681,683 | A | 8/1928 | Ramer |
| 3,580,581 | A | 5/1971 | Raven |
| 4,306,768 | A | 12/1981 | Egging |
| 4,448,419 | A | 5/1984 | Telnaes |
| 4,686,521 | A | 8/1987 | Beaven et al. |
| 4,711,451 | A | 12/1987 | Pajak et al. |
| 4,718,672 | A | 1/1988 | Okada |
| 4,743,022 | A | 5/1988 | Wood |
| 4,743,024 | A | 5/1988 | Helm et al. |
| 4,756,531 | A | 7/1988 | DiRe et al. |
| 4,826,169 | A | 5/1989 | Bessho et al. |
| 4,838,552 | A | 6/1989 | Hagiwara |
| 4,856,787 | A | 8/1989 | Itkis |
| 4,871,171 | A | 10/1989 | Rivero |
| 5,019,973 | A | 5/1991 | Wilcox |
| 5,042,818 | A | 8/1991 | Weingardt |
| 5,088,737 | A | 2/1992 | Frank et al. |
| 5,150,907 | A | 9/1992 | Desmarais et al. |
| 5,228,693 | A | 7/1993 | Howard |
| 5,283,560 | A | 2/1994 | Bartlett |
| 5,344,145 | A | 9/1994 | Chadwick et al. |
| 5,351,966 | A | 10/1994 | Tohyama et al. |
| 5,354,069 | A | 10/1994 | Guttman et al. |
| 5,356,140 | A | 10/1994 | Dabrowski et al. |

(Continued)

FOREIGN PATENT DOCUMENTS

| | | |
|---|---|---|
| AU | 117509 | 12/1988 |

(Continued)

OTHER PUBLICATIONS

Fey, Marshall, "Slot Machines A Pictorial History of the First 100 Years", 1983-1997, Liberty Belle Books, selected pages supplied by the Examiner as cited in U.S. Appl. No. 10/001,433.

(Continued)

*Primary Examiner* — Corbett B Coburn

(74) *Attorney, Agent, or Firm* — McAndrews, Held & Malloy, Ltd.

(57) ABSTRACT

A gaming machine including a display. The display includes a plurality of display positions for displaying combinations of symbols. A controller controls operation of the machine. The controller includes a processor for processing data and displaying selected data on the display. A selector is operable by the player of the machine for enabling the player to select at least one feature which can be added to a base game played on the machine.

30 Claims, 9 Drawing Sheets

U.S. PATENT DOCUMENTS

| | | | |
|---|---|---|---|
| 5,375,830 | A | 12/1994 | Takemoto et al. |
| 5,380,007 | A | 1/1995 | Travis et al. |
| 5,393,057 | A | 2/1995 | Marnell, II |
| 5,395,111 | A | 3/1995 | Inoue |
| 5,462,277 | A | 10/1995 | Takemoto |
| 5,580,053 | A | 12/1996 | Crouch |
| 5,588,650 | A | 12/1996 | Eman et al. |
| 5,596,693 | A | 1/1997 | Needle et al. |
| 5,630,753 | A | 5/1997 | Fuchs |
| 5,664,999 | A | 9/1997 | Kurihara |
| 5,673,401 | A | 9/1997 | Volk et al. |
| 5,704,835 | A | 1/1998 | Dietz, II |
| 5,732,950 | A | 3/1998 | Moody |
| 5,752,881 | A | 5/1998 | Inoue |
| 5,788,573 | A | 8/1998 | Baerlocher et al. |
| 5,803,809 | A | 9/1998 | Yoseloff |
| 5,807,172 | A | 9/1998 | Piechowiak |
| 5,807,178 | A | 9/1998 | Todokoro |
| 5,816,915 | A | 10/1998 | Kadlic |
| 5,816,916 | A | 10/1998 | Moody |
| 5,823,873 | A | 10/1998 | Moody |
| 5,836,586 | A | 11/1998 | Marks et al. |
| 5,848,932 | A | 12/1998 | Adams |
| 5,853,325 | A | 12/1998 | Kadlic |
| 5,867,166 | A | 2/1999 | Myhrvold et al. |
| 5,868,619 | A | 2/1999 | Wood et al. |
| 5,870,097 | A | 2/1999 | Snyder et al. |
| 5,880,709 | A | 3/1999 | Itai et al. |
| 5,890,962 | A | 4/1999 | Takemoto |
| 5,902,184 | A | 5/1999 | Bennett |
| 5,935,002 | A | 8/1999 | Falciglia |
| 5,947,820 | A | 9/1999 | Morro et al. |
| 5,947,821 | A | 9/1999 | Stone |
| 5,951,397 | A | 9/1999 | Dickinson |
| 5,971,849 | A | 10/1999 | Falciglia |
| 5,980,384 | A | 11/1999 | Barrie |
| 6,004,208 | A | 12/1999 | Takemoto et al. |
| 6,007,066 | A | 12/1999 | Moody |
| 6,050,568 | A | 4/2000 | Hachquet |
| 6,050,895 | A | 4/2000 | Luciano, Jr. et al. |
| 6,059,289 | A | 5/2000 | Vancura |
| 6,062,978 | A | 5/2000 | Martino et al. |
| 6,089,977 | A | 7/2000 | Bennett |
| 6,089,978 | A | 7/2000 | Adams |
| 6,098,985 | A | 8/2000 | Moody |
| 6,106,393 | A | 8/2000 | Sunaga et al. |
| 6,110,043 | A | 8/2000 | Olsen |
| 6,113,102 | A | 9/2000 | Marks et al. |
| 6,118,427 | A | 9/2000 | Buxton et al. |
| 6,120,031 | A | 9/2000 | Adams |
| 6,120,378 | A | 9/2000 | Moody |
| 6,123,333 | A | 9/2000 | McGinnis, Sr. et al. |
| 6,126,542 | A | 10/2000 | Fier |
| 6,135,883 | A | 10/2000 | Hachquet |
| 6,135,884 | A | 10/2000 | Hedrick et al. |
| 6,149,156 | A | 11/2000 | Feola |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,173,955 | B1 | 1/2001 | Perrie et al. |
| 6,190,254 | B1 | 2/2001 | Bennett |
| 6,203,428 | B1 | 3/2001 | Giobbi et al. |
| 6,203,429 | B1 | 3/2001 | Demar et al. |
| 6,213,875 | B1 | 4/2001 | Suzuki |
| 6,234,897 | B1 | 5/2001 | Frohm et al. |
| 6,251,013 | B1 | 6/2001 | Bennett |
| 6,261,177 | B1 | 7/2001 | Bennett |
| 6,270,405 | B1 | 8/2001 | Ferguson |
| 6,312,334 | B1 | 11/2001 | Yoseloff |
| 6,315,660 | B1 | 11/2001 | DeMar et al. |
| 6,317,128 | B1 | 11/2001 | Harrison et al. |
| 6,322,309 | B1 | 11/2001 | Thomas et al. |
| 6,354,939 | B1 | 3/2002 | Morita et al. |
| 6,368,216 | B1 | 4/2002 | Hedrick et al. |
| 6,380,956 | B1 | 4/2002 | Yee et al. |
| 6,443,837 | B1 | 9/2002 | Jaffe et al. |
| 6,454,266 | B1 | 9/2002 | Breeding et al. |
| 6,482,089 | B2 | 11/2002 | DeMar et al. |
| 6,505,117 | B1 | 1/2003 | Ratert et al. |
| 6,506,116 | B1 | 1/2003 | Sunaga et al. |
| 6,508,707 | B2 | 1/2003 | DeMar et al. |
| 6,520,855 | B2 | 2/2003 | DeMar et al. |
| 6,529,626 | B1 | 3/2003 | Watanabe et al. |
| 6,533,660 | B2 | 3/2003 | Seelig et al. |
| 6,582,305 | B1 | 6/2003 | Carter |
| 6,587,118 | B1 | 7/2003 | Yoneda |
| 7,115,033 | B1 | 10/2006 | Timperley |
| 2002/0155873 | A1 | 10/2002 | Berman |
| 2007/0060240 | A1 | 3/2007 | White |
| 2009/0239605 | A1 | 9/2009 | Ekisheva et al. |
| 2010/0124989 | A1 | 5/2010 | Englman et al. |

FOREIGN PATENT DOCUMENTS

| | | |
|---|---|---|
| AU | 70382 | 8/1995 |
| AU | 708104 | 10/1997 |
| AU | 45197 | 1/1998 |
| AU | 711501 | 10/1999 |
| AU | 420504 | 12/1999 |
| AU | 1999-43488 | 3/2000 |
| AU | 721968 B2 | 7/2000 |
| AU | 771847 | 4/2004 |
| DE | 2938307 | 9/1981 |
| DE | 4426658 | 1/1996 |
| EP | 0368628 | 5/1990 |
| GB | 1535095 | 12/1978 |
| GB | 2056737 | 3/1981 |
| GB | 2072395 | 9/1981 |
| GB | 2098778 | 11/1982 |
| GB | 2137392 | 10/1984 |
| GB | 2222712 | 3/1990 |
| GB | 2229371 | 9/1990 |
| GB | 2233241 | 1/1991 |
| GB | 2252705 | 8/1992 |
| GB | 2271262 | 4/1994 |
| JP | 04114676 | 4/1992 |
| WO | 9303464 | 2/1993 |
| WO | 9608799 | 3/1996 |
| WO | 97131344 | 8/1997 |
| WO | 9732285 | 1/1998 |
| WO | 9900164 | 1/1999 |
| WO | 9964997 | 12/1999 |
| WO | 0032286 | 6/2000 |
| WO | 0115055 A1 | 3/2001 |

OTHER PUBLICATIONS

Amended Particulars of Invalidity, filed on behalf of the Respondent/Cross-Claimant by Benjamin Lee Miller, Blake Dawson, in the Federal Circuit Court of Australia, New South Wales District Registry, General Division, between Aristocrat Technologies Australia Pty Ltd., ACN 001 660 715, Applicant/Cross-Respondent and IGT (Australia) Pty Ltd., ACN 002 904 690, Respondent/Cross-Claimant, dated Mar. 3, 2011.

GAMING MACHINE WITH BUY FEATURE GAMES

RELATED APPLICATIONS

This application claims priority to and benefit as a continuation of U.S. patent application Ser. No. 10/070,266, filed on Jul. 19, 2002 now abandoned, entitled "Gaming Machine With Buy Feature Games," which claims priority to International Application PCT/AU00/00997, filed on Aug. 23, 2000, which in turn claims priority to Australian Application No. PQ 2428, filed on Aug. 25, 1999, each of which is herein incorporated by reference in its entirety.

FIELD OF THE INVENTION

The present invention relates to a gaming machine. More particularly, the invention relates to a gaming machine of the type known as a slot machine or a fruit machine. Certain types of these machines have a series of rotatable reels, each of which displays a series of symbols or a video simulation of such a mechanism while other types of machines are arranged to play video simulations of card games or other types of wagering games, such as bingo or keno. The invention has particular application to an improved game played on such a machine.

BACKGROUND TO THE INVENTION

Players regularly playing gaming machines need to have their interests maintained. Therefore, it is necessary for manufacturers of these machines to develop inventive game features which add interest to the games provided on such machines in order to keep the players entertained and willing to continue to play the games.

There is a continuous trade-off between what the players of the machines want and what the operators of the machines want from the machines. Naturally, operators want the players to stake more money per game so that the overall turnover is higher. Conversely, players will not do this unless they feel that they are getting more for the extra money that they are betting.

Further, as the range of machines and games increases, it is becoming increasingly important to offer more options to the players. The more options that are available in one machine, the easier it is to maintain the player's interest and the easier it is for players to be able to gain access to a machine that will offer them exactly the game that they want.

To date, most types of video gaming machines which are available to players offer limited options. At best, a range of bet sizes and paylines upon which the players can bet are offered. Certain machines also offer a double-up option available after a win while other machines have various ranges of paytables particularly for higher bets.

SUMMARY OF THE INVENTION

According to the invention there is provided a gaming machine which includes:

a display means including a plurality of display positions for displaying combinations of symbols;

a control means for controlling operation of the machine, the control means including a processing means for processing data and displaying selected data on the display means; and a selecting means operable by a player of the machine for enabling the player to select at least one feature which can be added to a base game played on the machine.

The base game may have no features at all. For example, in the case of a video simulation of a spinning reel game, there would be no scatter symbol or substitute symbol or feature triggered by the occurrence of a predetermined or random event. Instead, by means of the selecting means, the player may be able to select at least one and, preferably, a range of features that can be added to the base game to tailor the base game to the player's requirements. Various features may be offered. For example, certain symbols may be selected to pay as scatter symbols or substitute symbols as well as or in addition to the standard pays. Other examples include additional types of pays, for example, right to left as well as the basic left to right pay or bonus features such as free games, bonus pays, etc which are triggered by certain combinations.

Certain features may be offered as no-cost features which are selected by the player by means of the selecting means. Other features may have a cost associated therewith a player having to stake additional credit to obtain the feature or eligibility to the feature. If desired, the bet to obtain one or more features may be independent of the type or size of bet made on the base game. Thus, it is not necessary for the maximum bet to be placed on the base game before access can be gained to the range of features. In addition, the cost for the various features may differ depending on the type of feature or range of features selected.

In one embodiment of the invention, where only one additional feature or a range of the same type of feature is offered, the additional credit staked by the player may be a multiple of a base bet wagered by the player. Different multiples of the base bet may purchase different features of that type. For example, a bet X2 feature may purchase two free spins, a bet X3 feature may purchase four free spins and bet X4 feature may purchase six free spins.

The selecting means may include a plurality of selectors, such as buttons on the midtrim, operable by the player to select the feature required before making the base bet. One of the buttons may be used by the player when only the base bet is to be staked.

Only one feature, if any, at a time may be selectable by the player by means of the selectors. For example, a standard bet with no additional feature may be wagered, or a bet with only one type of feature may be wagered.

The additional credit staked may only provide eligibility to a benefit provided by that feature, there being no guarantee that the feature will eventuate merely by having staked the additional credit. Hence, the player will not necessarily see a direct result of the extra stake for every game played. For example, a predetermined combination may need to appear to trigger the special feature (eg. free spins) or to pay a bonus prize (eg a right to left pay).

In another embodiment of the invention, the additional credit staked may be a fixed amount multiplied by a bet wagered per line (for a spinning reel game) or per draw (for a card game).

The feature for which the additional credit is staked may be triggered independently of the base game. In other words, a random selection is made by the control means as to whether or not to trigger the feature completely independently of the base game.

Further, the gaming machine may be a multi-game machine having various games. Then, the appropriate game may initially be chosen and, thereafter, the required feature or features for the game may be selected by the player.

The selecting means may include dedicated keys or buttons on a keypad of the gaming machine and/or a touch or interactive screen of the display mean for enabling the features and/or games to be selected.

BRIEF DESCRIPTION OF DRAWINGS

The invention is now described by way of example with reference to the accompanying diagrammatic drawings in which.

DETAILED DESCRIPTION OF THE DRAWINGS

Figure 1:
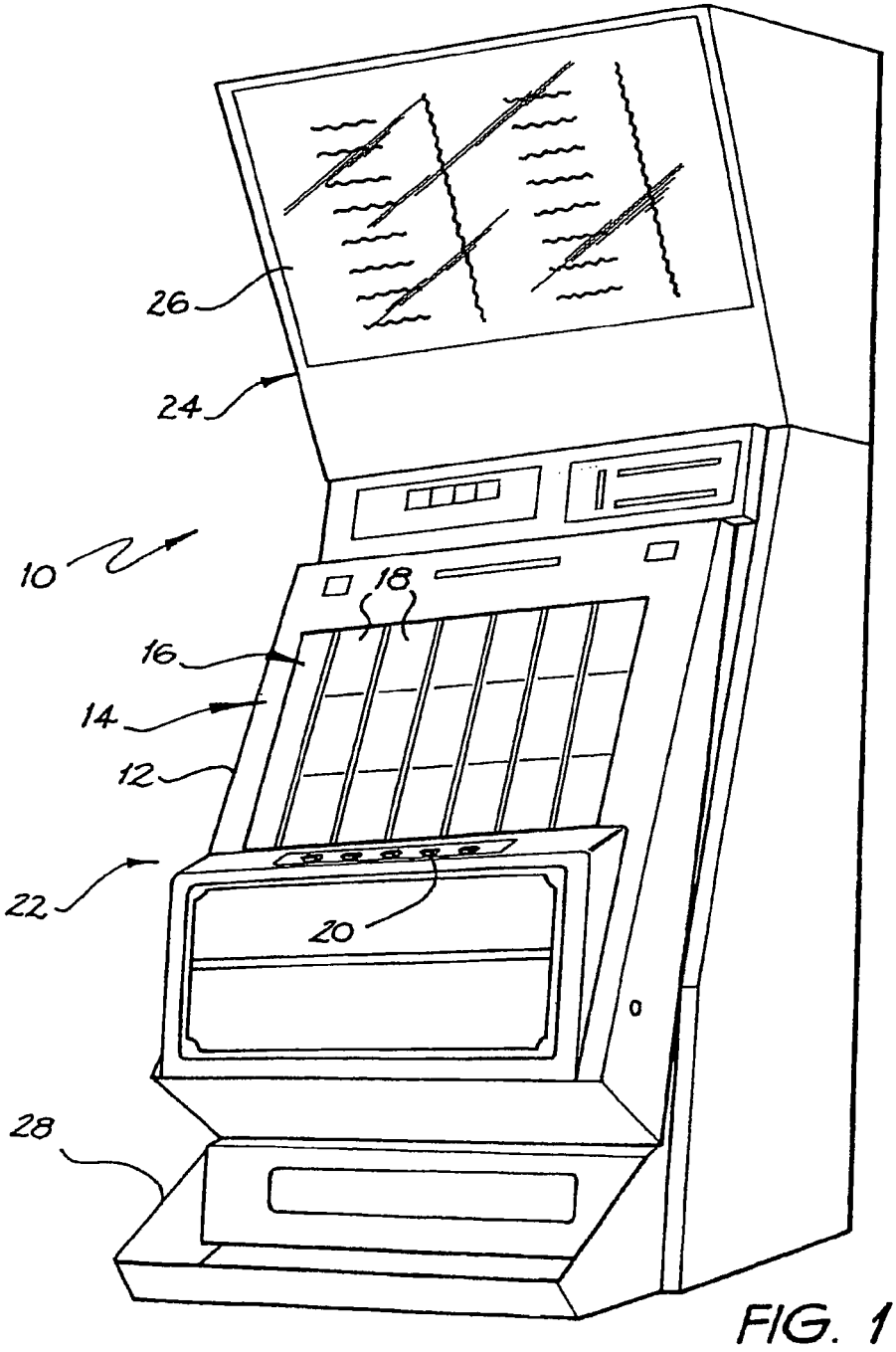
FIG. 1 shows a three dimensional view a gaming machine.

In FIG. 1, reference numeral 10 generally designates a gaming machine, including a game, in accordance with the invention. The machine 10 includes a gaming console 12 having a video display unit 14. The video display unit includes a screen 16 on which reels 18 are simulated. A keypad 20, which is shown in greater detail in FIG. 3 of the drawings, is mounted on a midtrim 22 of the machine 10.

The machine includes a topbox 24 on which a paytable 26 is arranged.

Figure 2:
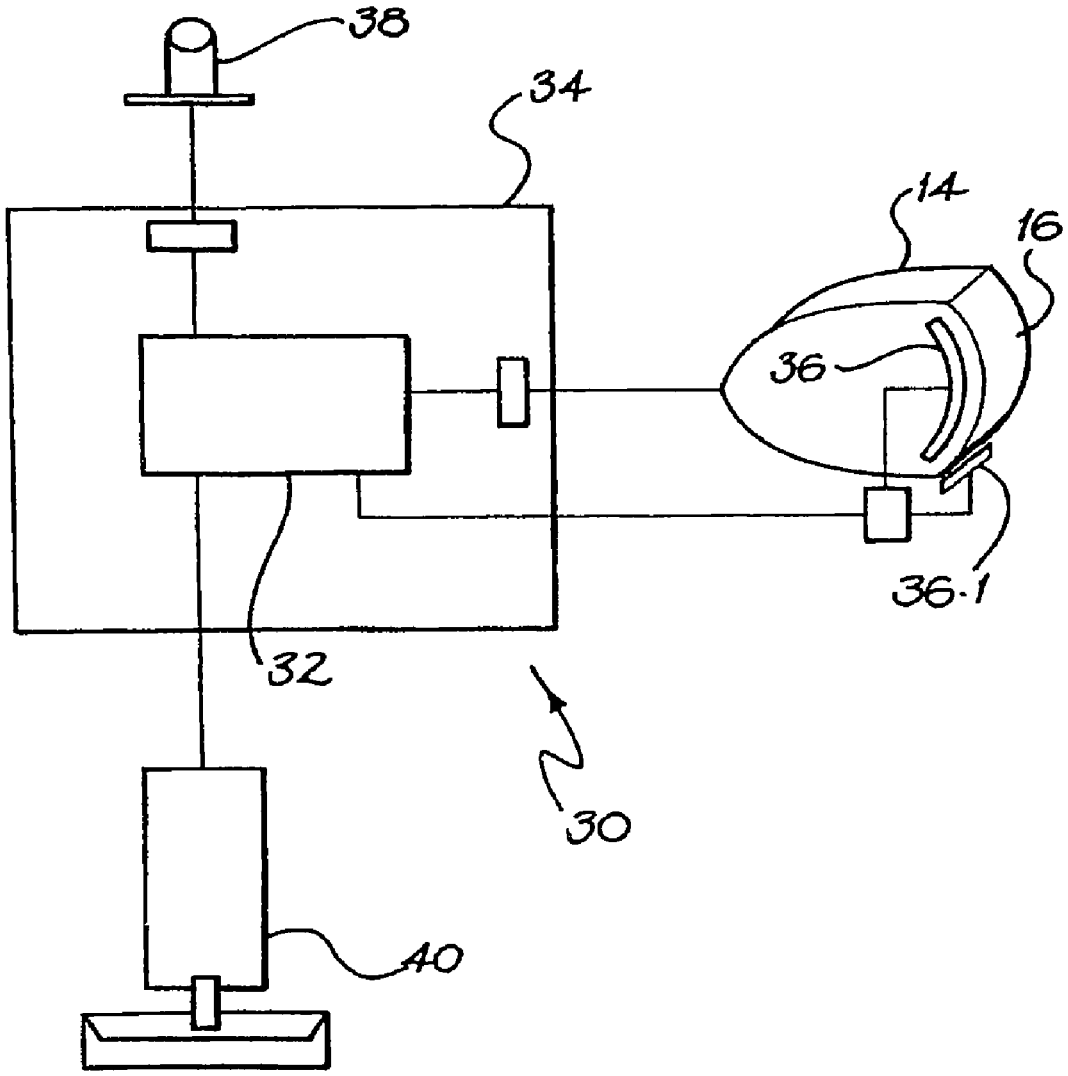
FIG. 2 shows a block diagram of a control means of the gaming machine.

Referring now to FIG. 2 of the drawings, a control means 30 of the machine 10 is illustrated. A program which implements the game and user interface is run on a processor 32 of the control means 30. The processor 32 forms part of a controller 34 which drives the screen 16 of the video display unit 14. The processor 32 receives input signals from a first group of sensors 36.1 which are responsive to keys of the keypad 20. A second group of sensors 36.2 are touch sensors associated with the screen 16 of the video display unit 14.

The controller 34 also receives input pulses from a mechanism 38 indicating that a player has provided sufficient credit to begin playing. The mechanism 38 may be a coin input chute, a bill collector, a credit card reader, any other type of validation device, or a combination thereof.

The controller 34 also controls a payout mechanism 40 which, for example, may be a coin hopper for feeding coins to a coin tray 28 of the machine 10.

With the game of the gaming machine 10, a player playing the machine 10 has the option to make a bet that is a multiple of a base bet to buy an additional feature to the game. The additional bet need not be a multiple of the specified maximum bet of the machine 10. Thus, the player is allowed to, for example, double or treble their initial bet to be eligible for an additional game feature. In this way, even players who bet a single credit on one line (on a multi-line game), are eligible to buy features, by doubling or trebling their bets.

The extra bet that the player is required to make does not make any change to the game the player has bought other than to introduce eligibility to the feature. In other words, no additional pay lines are bought or linear increases made to the pay table as the extra bet is a dedicated bet towards the feature.

Figure 3:
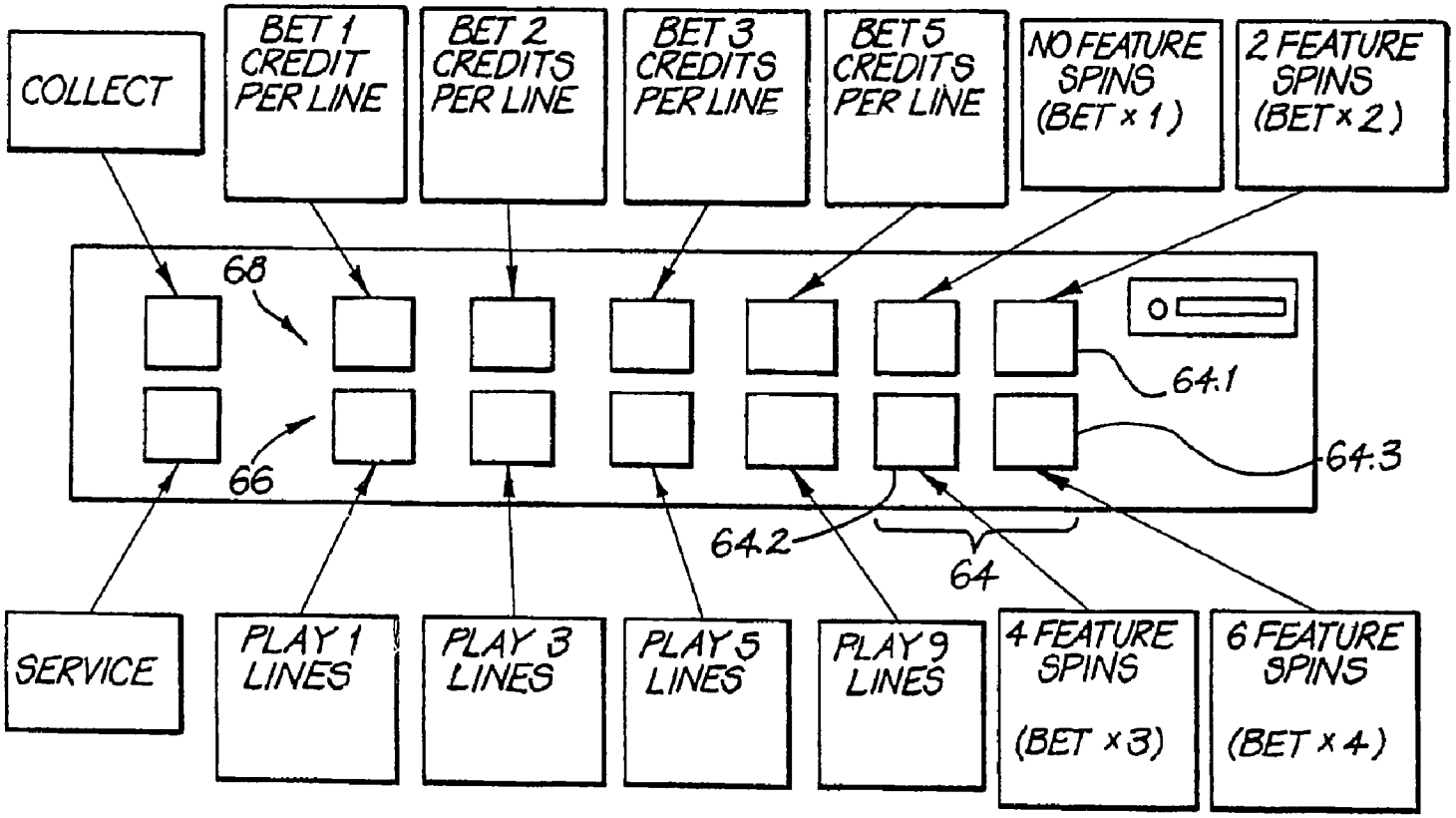
FIG. 3 shows a schematic plan representation of one embodiment of a keypad of the gaming machine.

Referring now to FIG. 3 of the drawings a modified keypad 20 for the machine is shown. Instead of, or in addition, to the touch screen facility in the screen 16 of the video display unit 14 of the machine 10, dedicated buttons 64 are provided on the keypad 20.

The keypad 20 has a conventional array of buttons 66 for enabling the player to select the number of lines of the machine on which to achieve a payout as well as a conventional array of buttons 68 for enabling the player to select the number of credits to be bet per line.

A "base bet" is represented by the buttons 68 labelled "Bet x credits per line" and the buttons 66 labelled "Play x lines". The feature of the game is that if a player stakes double the base bet by means of button 64.1 then, whenever a specified combination of symbols is spun up, certain reel positions will be held while the rest of the reels are spun again twice for free. For triple the base bet (button 64.2) the same combination would result in four free spins and for quadruple the base bet (button 64.3) there would be six free spins. Thus, if the player is betting two credits per line on five lines then the base bet will be ten credits. If the player chooses to buy access to the four free spins feature by selecting the "four feature spins (bet x 3)" button 64.2 then a game will cost the player thirty credits. The payline prizes will still only be multiplied by the player's bet per line of two credits, and prize combinations will still only apply on the five lines that have been bought. However, the additional feature of a specified combination of symbols awarding four re-spins of some of the reels will apply. Accordingly, it will be noted that only the base bet or the base bet plus the additional credit for one type of feature may be wagered at any one time. Also, the mere wagering of the additional credit does not guarantee that the feature will occur. The wagering of the additional credit only provides eligibility for the applicable feature.

It will be appreciated that various other options could be provided by means of the appropriate number of buttons 64 on the keypad 20.

In this embodiment, other examples which are possible are, inter alia, the additional feature may be the purchase of a certain combination which, if obtained, will commence a free game series. Instead, an additional feature trigger symbol may be purchased so that, in addition to an original trigger symbol, the additional trigger symbol also provides a free spin feature. Yet further, a right-to-left payout feature, in addition to the more conventional left-to-right payout can be bought.

Figure 4:
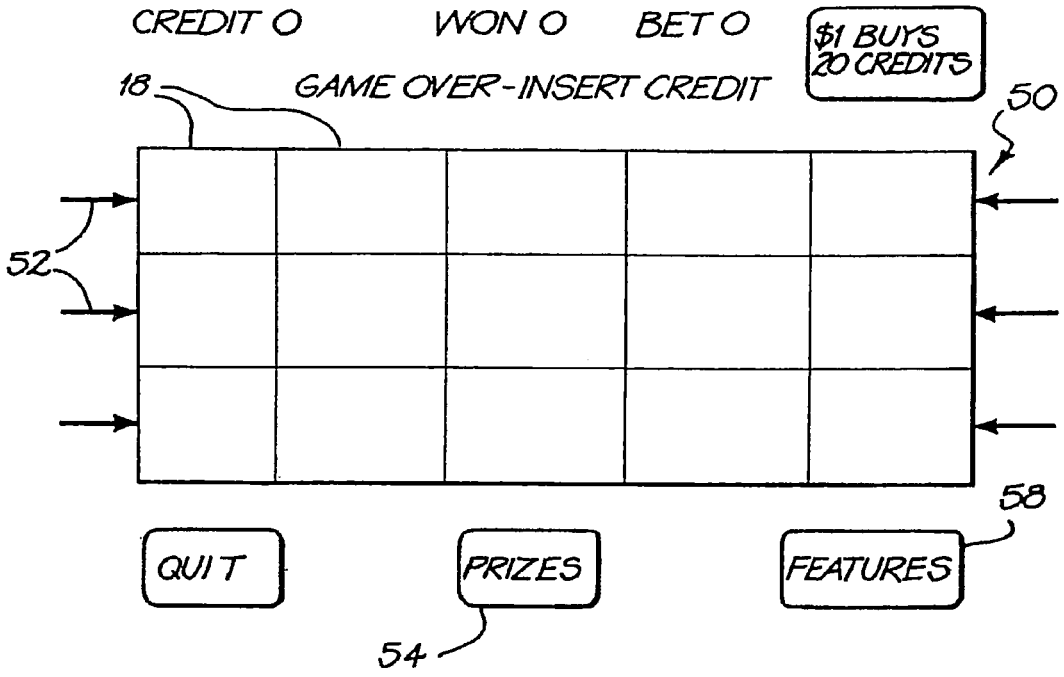
FIG. 4 shows a schematic representation of a first screen of the gaming machine.
Figure 5:
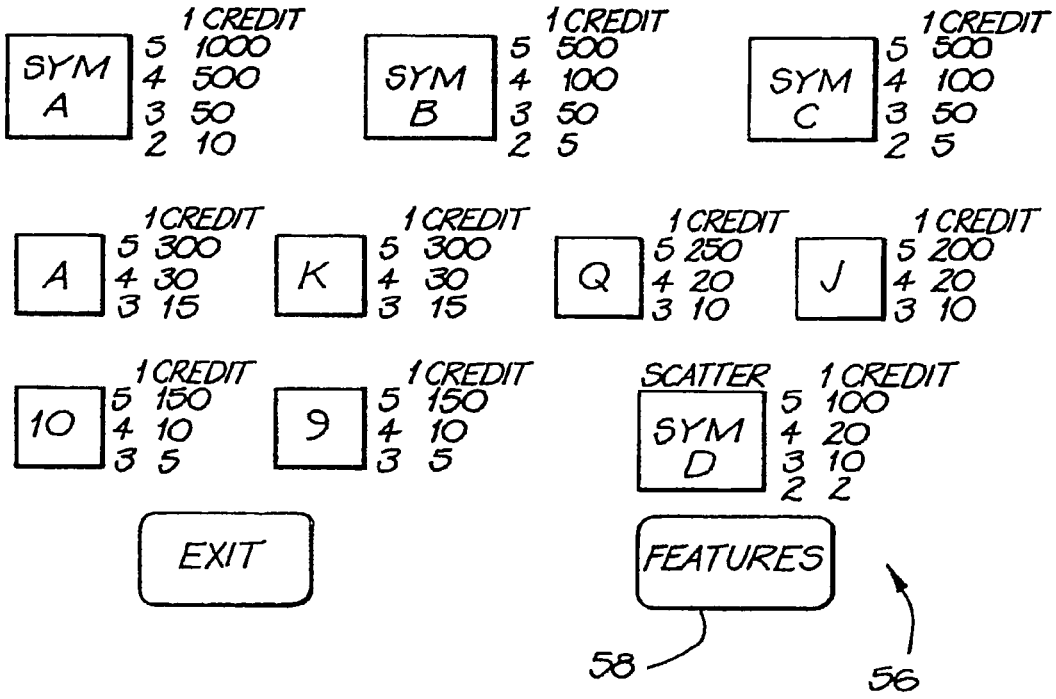
FIG. 5 shows a schematic representation of a second screen of the gaming machine.
Figure 6:
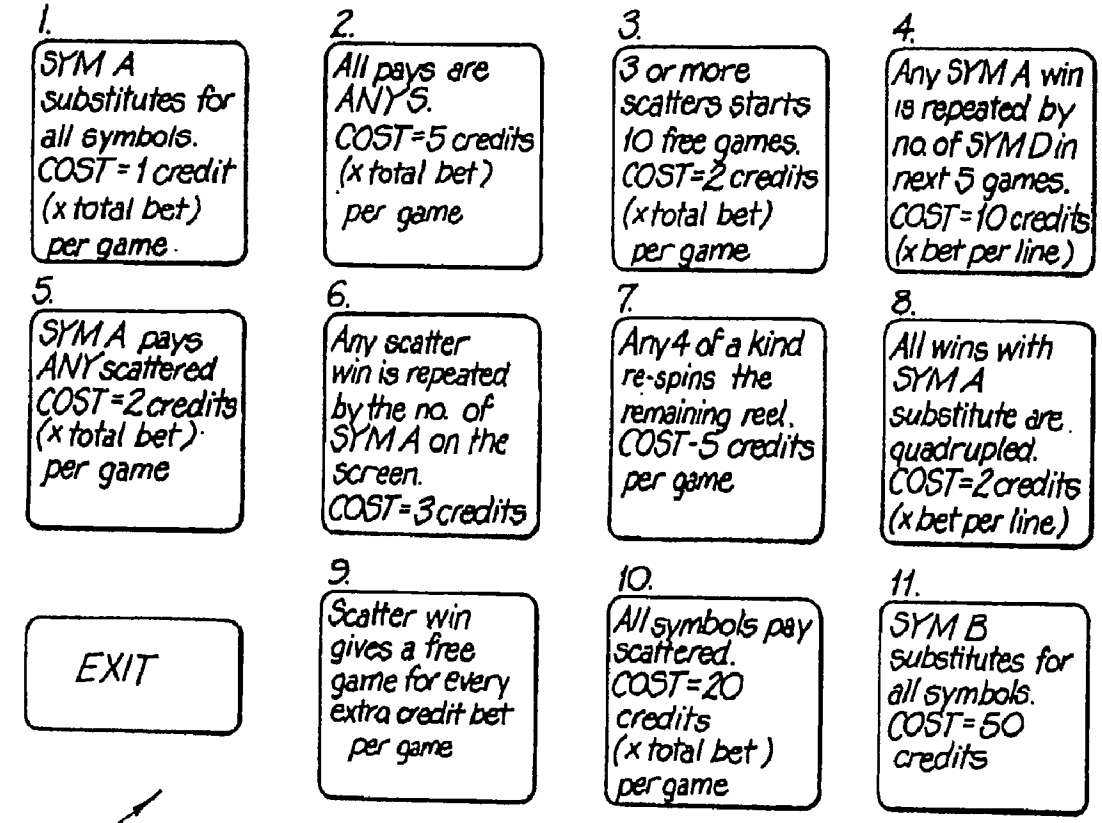
FIG. 6 shows a schematic representation of one embodiment of a third screen of the gaming machine.
Figure 7:
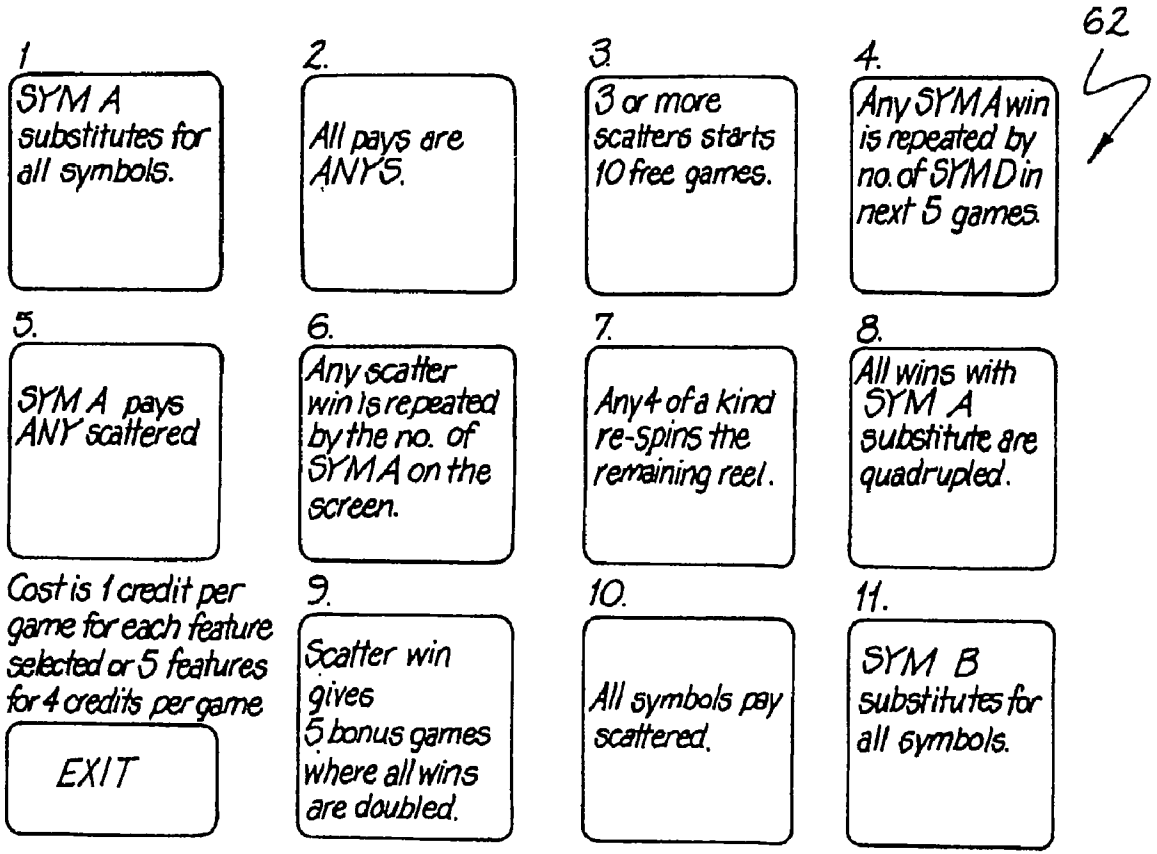
FIG. 7 shows a schematic representation of another embodiment of the third screen of the gaming machine.

To ensure versatility, the player may be given a choice of which features the player wishes to buy. Then, various icons are displayed on the screen as will now be described with reference to FIGS. 4 to 7 of the drawings. In FIG. 4, a basic game screen is shown and is designated generally by the reference numeral 50. The game screen has the usual reels 18 and multi-line pays as indicated by the arrows 52. If the player touches the icon "Prizes" as indicated at 54, a screen 56 shown in FIG. 5 of the drawings is displayed to show what prizes are available to the player. By touching the icon 58 entitled "Features" either a screen 60 as shown in FIG. 6 of the drawings or a screen 62, as shown in. FIG. 7 of the drawings is displayed. The screens 60 and 62 are similar with the difference between the screens being that, in the case of the screen illustrated in FIG. 7 of the drawings, the bet to be made by the player is independent of the type of feature altogether.

The screen in FIG. 6 or 7 allows the players to select the features required. The various icons illustrated as representations of the screens in FIGS. 6 and 7 are largely self explanatory. Suffice to say that a player can select various available options to construct their own games at a cost which that player can afford. The cost may be relative to an aspect of the base bet, ie the bet made for the basic game, or independent of the base bet. In addition, the player may be able to nominate the amount they wish to pay for eligibility to a particular feature.

In addition, in this embodiment, various features may be offered by the machine 10 such as, for example, certain combinations of a particular symbol triggering a bonus mode where for the next 10 games each symbol of another type that appears pays a bonus. As a further example, a bought feature could be that a particular symbol acts as a substitute symbol for all other symbols or pays for scattered combinations instead of just on a pay line. Hence, it will be appreciated that a large number of features could be built into the machine 10 to be offered to the players. By the player increasing his or her initial bet, eligibility to the feature is gained.

Figure 8:
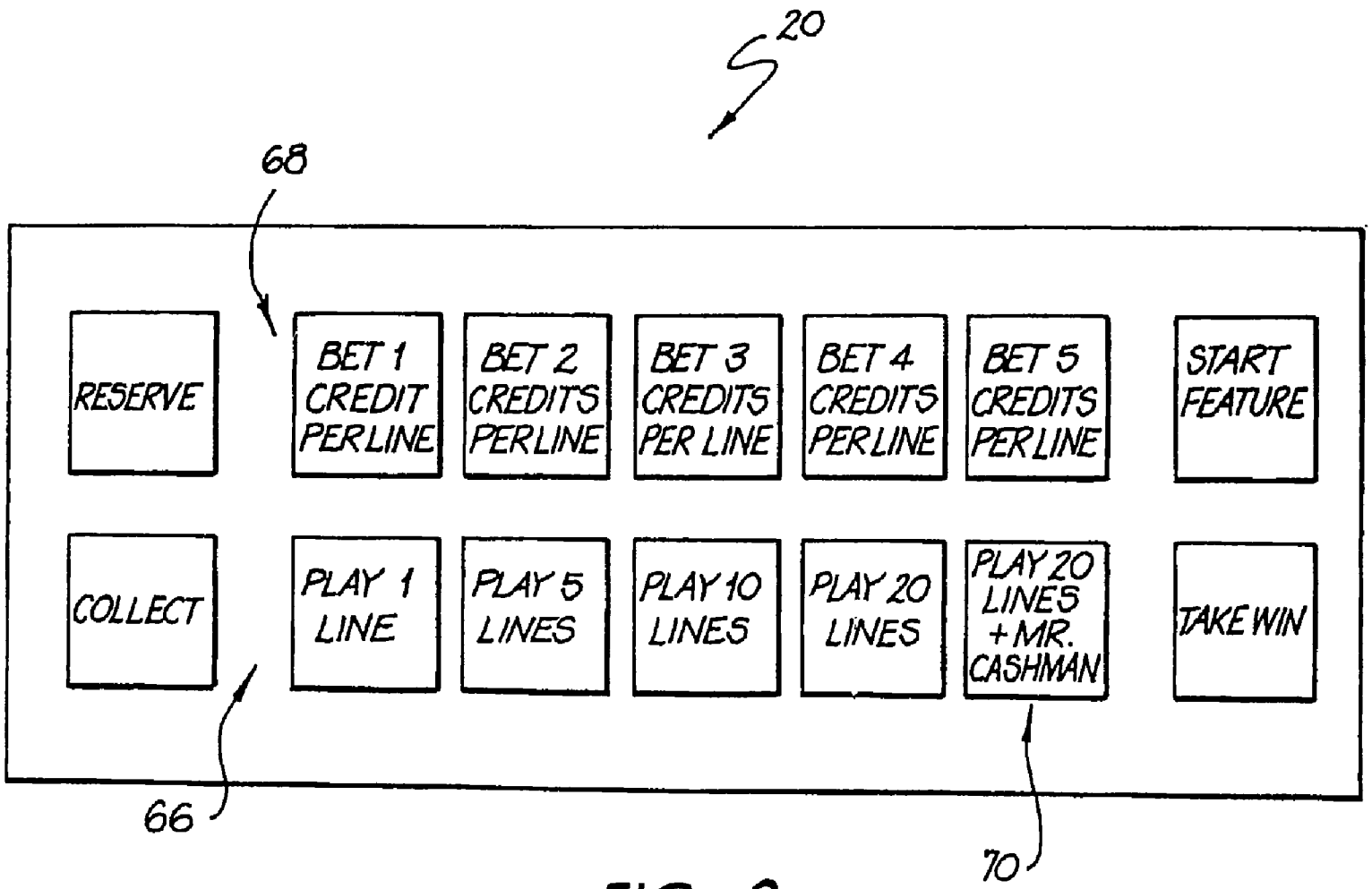
FIG. 8 shows a schematic plan representation of another embodiment of a keypad of the gaming machine.

Referring now to FIG. 8 of the drawings, a keypad 20 in accordance with another embodiment of the invention is illustrated. With reference to FIG. 3 of the drawings, like reference numerals refer to like parts, unless otherwise specified.

In this embodiment of the invention, instead of the buttons 64, a selection button 70 is provided.

Figure 9:
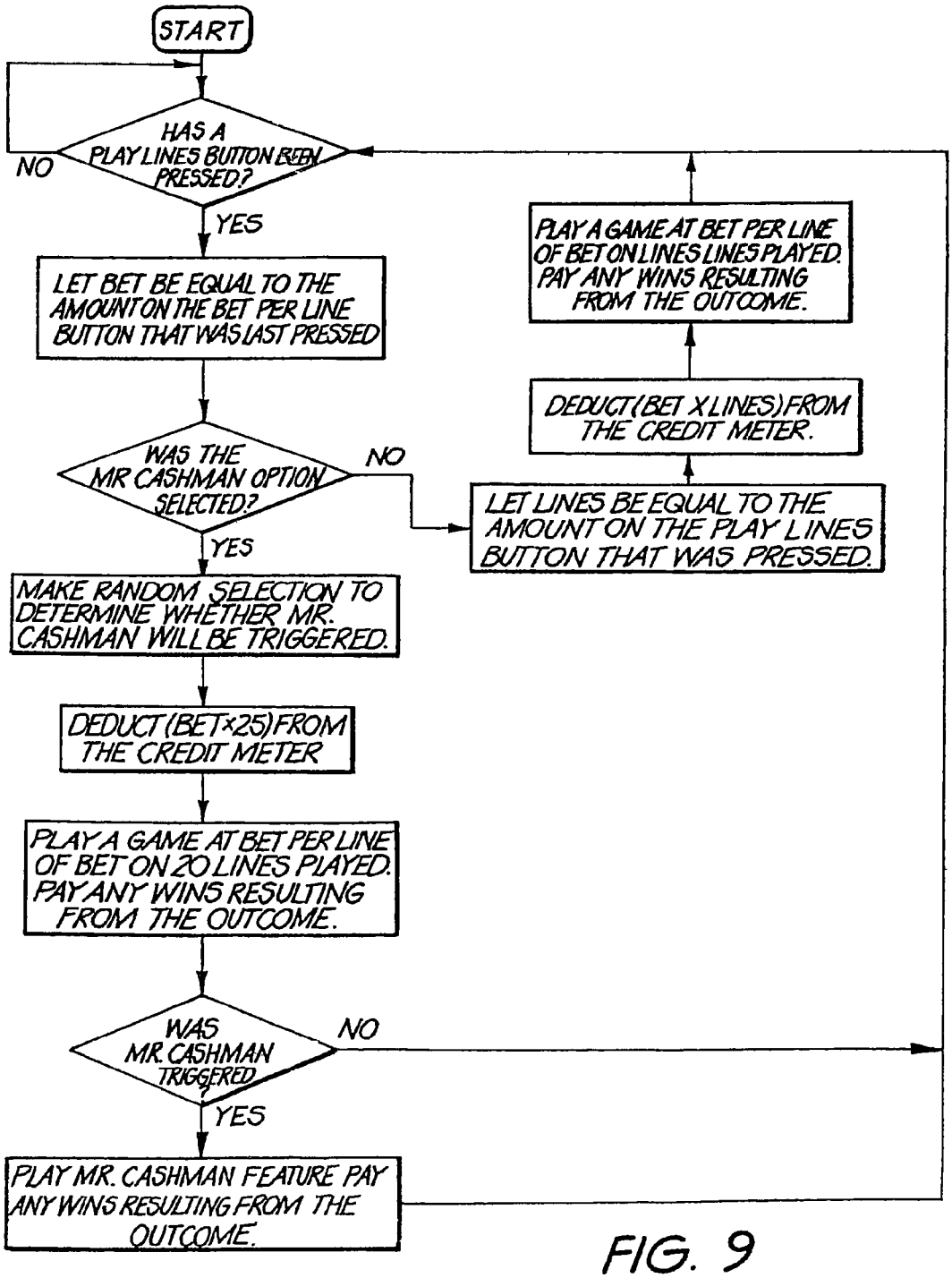
FIG. 9 shows a flow chart of the operation of the embodiment of the invention described with reference to FIG. 8.

In this embodiment of the invention, as illustrated in FIG. 9, the player is required to make a special bet in order to be eligible for the feature. The feature, in this embodiment is the applicant's Mr. Cashman. Mr. Cashman is a trademark for the applicant and is described in detail in our co-pending PCT Application Number PCT/AU99/01059 dated 26 Nov. 1999 and entitled "Player Information Delivery." The contents of PCT/AU99/01059 are specifically incorporated herein by reference. The selection of the Mr. Cashman feature is by way of the selection button 70. If the player chooses not to play the Mr. Cashman feature, then bets are made in the standard way using the standard buttons 66 and 68.

The Mr Cashman feature is, as illustrated, restricted to the maximum number of lines available for the game configuration. Thus, in the example illustrated, the Mr Cashman feature is provided when the player selects that feature and also elects to play the maximum number of lines being 20 lines. By selecting the feature using the button 70, the player will be eligible to enter the Mr Cashman feature for that game.

The extra cost involved for eligibility to the Mr Cashman feature will be five credits multiplied by the number of credits bet per line. Hence, in the illustrated example, the player must stake 25 credits multiplied by the bet per line in order to be eligible for the Mr. Cashman feature. Once again, the mere wagering of the additional credit does not guarantee that the feature will occur but only that the player is eligible for the feature. The Mr. Cashman feature is not triggered by any trigger condition in the base game. Rather, a random selection is made by the controller 34 completely independently of the base game to determine whether the Mr. Cashman feature is to be triggered or not.

In other words, the player first makes a bet per line using the button 68 and then selects the number of lines to be played using buttons 66 or, where the player desires to include the Mr Cashman feature, the player activates the button 70.

Then, for each game played with the extra feature, the player will have a predetermined probability of triggering the Mr Cashman feature to commence after the base game has been completed.

Accordingly, by means of the invention a more versatile gaming machine 10 is provided which provides players with a greater number of options. In so doing, it is believed that the machines 10 will become more attractive to players.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine that provides a base game in which a player stakes a wager on an outcome of the base game, and if a winning outcome occurs, the gaming machine awards that player a prize, the gaming machine including:

a display that under the control of a game controller displays a plurality of display positions for displaying combinations of symbols;

the game controller controlling operation of the gaming machine, and displaying selected images on the display; and a selector operable by a player of the gaming machine to enable the player to select at least one feature which can be added to the base game, wherein the gaming machine requires the player to stake an additional wager in order to be eligible for the selected feature, the gaming machine being arranged to allow the additional wager to be staked independently of any outcome of the base game, wherein there is no guarantee that the selected feature will eventuate merely by having staked the additional wager, and wherein when the selected feature eventuates, said controller awards a series of game events from which a prize provided by the feature may be won.

2. The gaming machine of claim 1 wherein the selected feature is randomly triggered according to a particular one of said symbols or a combination of said symbols appearing in said outcome of the base game.

3. The gaming machine of claim 1 wherein said selector is operated to select a said one feature before staking the wager on an outcome of the base game.

4. The gaming machine of claim 1, wherein the base game provides a plurality of outcomes and the selector further enables the player to specify both the number of outcomes of the base game on which to stake a wager and the amount wagered on each said outcome, wherein the additional wager staked by the player in order to be eligible for the selected feature is a multiple of the amount wagered on each outcome of the base game.

5. The gaming machine of claim 1, wherein the game controller provides the base game so that it is not possible for a player of the gaming machine to be provided with the series of game events without the player staking the additional wager.

6. The gaming machine of claim 1, wherein the game controller provides the base game so that it is possible for a player of the gaming machine to be provided with the series of game events without the player staking the additional wager and wherein the additional wager increases the probability of occurrence of the series of game events.

7. The gaming machine of claim 6, wherein the series of game events is provided by the game controller on occurrence of a first trigger and a second trigger and wherein when the player has not staked the additional wager only the first trigger is active and when the player has staked the additional wager both the first trigger and the second trigger are active.

8. The gaming machine of claim 1, wherein the base game is a spinning reel game and the series of game events is a plurality of re-spins of at least one, but less than all of the reels.

9. The gaming machine of claim 1, wherein the series of game events is a plurality of plays of the base game modified so that on the occurrence of a particular combination of symbols the gaming machine awards a bonus, the bonus not being awardable for that particular combination in the base game without modification.

10. The gaming machine of claim 1, wherein the series of game events is a plurality of plays of the base game modified so that a particular symbol acts as a substitute or scatter symbol for other symbols, the symbol not acting as a substitute or scatter symbol in the base game without modification.

11. The gaming machine of claim 1, which is a multi-game machine having various games and including a game selector, which when operated by the player, causes one of the games to be selected as the base game.

12. The gaming machine of claim 1, wherein the selector includes at least one dedicated button on a keypad of the game controller.

13. The gaming machine of claim 1, wherein the selector includes touch sensors of a touch screen of the display.

14. The gaming machine of claim 1, wherein the series of game events is a series of free games.

15. The gaming machine of claim 1, wherein the feature eventuates on the occurrence of a trigger event and wherein the trigger event is independent of any outcome of the base game.

16. The gaming machine of claim 1, wherein provision of the series of game events is dependent on the display of a particular symbol or combination of symbols during play of the base game.

17. The gaming machine of claim 1 in which the additional wager staked by the player in order to be eligible for the selected feature is a multiple of the wager staked on an outcome of the base game.

18. The gaming machine of claim 1 in which there are at least two different features that can be added to the base game and different multiples of the wager staked on an outcome of the base game purchase different features.

19. The gaming machine of claim 18 wherein the selector includes a plurality of selector parts operable by the player to select one of said at least two different features before making the wager staked on an outcome of the base game.

20. The gaming machine of claim 19 in which the selector enables a player to select from a range of features to enable the player to tailor the game to the player's requirements.

21. A gaming machine which includes a display that under the control of a game controller displays a plurality of display positions for displaying combinations of symbols;

the game controller displaying selected data on the display; and a selector operable by a player of the machine that enables the player to select at least one feature which can be added to a base game played on the machine, and wherein said gaming machine is arranged to require an additional wager to be staked by the player in order to be eligible for said at least one feature, said additional wager (1) being staked independently of any outcome of the base game and (2) being a fixed amount multiplied by a bet wagered per line or per draw, there being no guarantee that a benefit provided by the feature will eventuate merely by having staked the additional wager;

and wherein when the selected feature eventuates, said controller awards a series of game events from which a prize provided by the feature may be won.

22. The gaming machine of claim 21 in which the selected feature is randomly triggered according to a particular one of said symbols or a particular combination of said symbols appearing in said outcome of said base game.

23. The gaming machine of claim 21, in which the selector is operable to select said one feature before staking the wager on an outcome of the base game.

24. The gaming machine of claim 23 wherein the gaming machine also provides further features that do not require the staking of an additional wager.

25. The gaming machine of claim 21, wherein a said feature is triggered independently of the base game.

26. The gaming machine of claim 21, which is a multi-game machine having various games and including a game selector, which when operated by the player, causes one of the games to be selected as the base game.

27. The gaming machine of claim 21, wherein the selector includes at least one dedicated button on a keypad of the game controller.

28. The gaming machine of claim 21, wherein the selector includes touch sensors of a touch screen of the display.

29. The gaming machine of claim 21 in which the selector is operable by the player to select the feature required before making a base bet.

30. The gaming machine of claim 21, in which the selector enables a player to select a range of features to enable the player to tailor the game to the player's requirements.

* * * * *

US008038524C1

(12) EX PARTE REEXAMINATION CERTIFICATE (9517th)

United States Patent
Bryant et al.

(10) Number: US 8,038,524 C1
(45) Certificate Issued: Feb. 20, 2013

(54) GAMING MACHINE WITH BUY FEATURE GAMES

(75) Inventors: Natalie Bryant, Lane Cove (AU); Nicholas Luke Bennett, Lane Cove (AU)

(73) Assignee: Aristocrat Technologies Australia Pty Ltd, Lane Cove NSW (AU)

Reexamination Request:
No. 90/011,966, Nov. 22, 2011

Reexamination Certificate for:

| | |
|---|---|
| Patent No.: | **8,038,524** |
| Issued: | **Oct. 18, 2011** |
| Appl. No.: | **12/018,605** |
| Filed: | **Jan. 23, 2008** |

Related U.S. Application Data

(63) Continuation of application No. 10/070,266, filed on Jul. 19, 2002, now abandoned.

(51) Int. Cl.
*A63F 9/24* (2006.01)

(52) U.S. Cl. ..... 463/20; 463/29; 463/25

(58) Field of Classification Search ..... None
See application file for complete search history.

(56) References Cited

To view the complete listing of prior art documents cited during the proceeding for Reexamination Control Number 90/011,966, please refer to the USPTO's public Patent Application Information Retrieval (PAIR) system under the Display References tab.

*Primary Examiner* — Michelle Tarae

(57) ABSTRACT

A gaming machine including a display. The display includes a plurality of display positions for displaying combinations of symbols. A controller controls operation of the machine. The controller includes a processor for processing data and displaying selected data on the display. A selector is operable by the player of the machine for enabling the player to select at least one feature which can be added to a base game played on the machine.

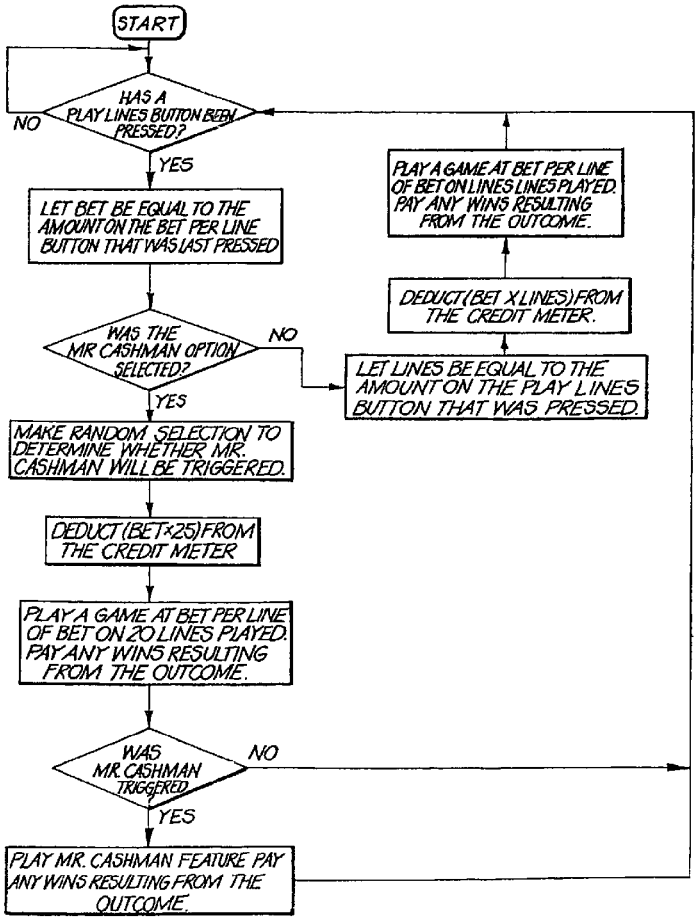

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3-4, 7, 17-19, 21 and 23 are determined to be patentable as amended.

Claims 2, 5-6, 8-16, 20, 22 and 24-30, dependent on an amended claim, are determined to be patentable.

1. A gaming machine that provides a base game in which a player stakes a *base game* wager on an outcome of the base game, and if a winning outcome occurs, the gaming machine awards that player a prize, the gaming machine including:

a display that under the control of a game controller displays a plurality of display positions for displaying combinations of symbols;

the game controller controlling operation of the gaming machine, [and] displaying selected images on the display*, and awarding the prize, the base game wager being a multiplier in determining the value of the prize*; and a selector operable by a player of the gaming machine to enable the player to select at least one feature which can be added to the base game, wherein the gaming machine requires the player to stake an additional wager in order to be eligible for the selected feature, the gaming machine being arranged [to allow] *such that* the additional wager *is allowed* to be staked independently of any outcome of the base game, [the ability to place] *the additional wager not influencing the value of the prize, and the additional wager being independent of a value of the base game wager placed on the outcome of the base game;* wherein there is no guarantee that the selected feature will eventuate merely by having staked the additional wager, and wherein when the selected feature eventuates, said controller awards a series of game events from which a prize provided by the feature may be won.

3. The gaming machine of claim 1 wherein said selector is operated to select a said one feature before staking the *base game* wager on an outcome of the base game.

4. The gaming machine of claim 1, wherein the base game provides a plurality of outcomes and the selector further enables the player to specify both the number of outcomes of the base game on which to stake [a] *the base game* wager and the amount wagered on each said outcome, wherein *a cost for the* additional wager staked by the player in order to be eligible for the selected feature is *the product of* a [multiple of] *multiplier applied to* the amount wagered on each outcome of the base game.

7. The gaming machine of claim 6, wherein the series of game events is provided by the game controller on occurrence of a first trigger and a second trigger and wherein when the player has not staked the additional wager only the first trigger is active and when the player has staked the additional wager both the first trigger and the second trigger are active*, and wherein the second trigger is not the additional wager*.

17. The gaming machine of claim 1 in which the additional wager staked by the player in order to be eligible for the selected feature is a multiple of the *base game* wager staked on an outcome of the base game.

18. The gaming machine of claim 1 in which there are at least two different features that can be added to the base game and different multiples of the *base game* wager staked on an outcome of the base game purchase different features.

19. The gaming machine of claim 18 wherein the selector includes a plurality of selector parts operable by the player to select one of said at least two different features before making the *base game* wager staked on an outcome of the base game.

21. A gaming machine which includes*:* a display that under the control of a game controller displays a plurality of display positions for displaying combinations of symbols;

the game controller displaying selected data on the display *and controlling awarding a prize for a winning outcome on which a player staked a base game wager for a base game, the base game wager being a multiplier in determining the value of the prize*; and a selector operable by a player of the *gaming* machine that enables the player to select at least one feature which can be added to [a] *the* base game played on the *gaming* machine, and wherein [said] *the* gaming machine is arranged to require an additional wager to be staked by the player in order to be eligible for said at least one feature, [said] *the* additional wager (1) being staked independently of any outcome of the base game, and (2) being a fixed amount multiplied by a bet wagered per line or per draw, [the ability to place] *wherein the additional wager is independent of a value of the base game wager placed on the outcome of the base game,* there being no guarantee that a benefit provided by the feature will eventuate merely by having staked the additional wager;

and wherein when the selected feature eventuates, said controller awards a series of game events from which a prize provided by the feature may be won.

23. The gaming machine of claim 21, in which the selector is operable to select said one feature before staking the *base game* wager on an outcome of the base game.

* * * * *